US005131675A

United States Patent [19]

Haldemann et al.

[11] Patent Number: 5,131,675

[45] Date of Patent: Jul. 21, 1992

[54] CENTRAL BINDING FOR SKI WITH MOUNTING SUPPORT HAVING SEPARATED ELEMENTS

[75] Inventors: Gaston Haldemann, Furigen; Francois Wirz, Saviese, both of Switzerland

[73] Assignee: Galde AG, Stans, Switzerland

[21] Appl. No.: 566,293

[22] Filed: Aug. 9, 1990

[30] Foreign Application Priority Data

Aug. 16, 1989 [CH] Switzerland ..... 2997/89

[51] Int. Cl.[5] ..... A63C 9/08

[52] U.S. Cl. ..... 280/617; 280/618; 280/633

[58] Field of Search ..... 280/617, 618, 630, 602, 280/601, 607, 610, 611, 613, 633, 636, 616

[56] References Cited

U.S. PATENT DOCUMENTS 3,790,186 2/1974 Kanno ..... 280/617
3,902,729 9/1975 Druss ..... 280/613
3,925,911 12/1975 Erlebach ..... 280/613
4,522,423 6/1985 Haldemann et al. ..... 280/624
4,536,006 8/1985 Haldemann et al. ..... 280/613
4,735,845 4/1988 Haldemann et al. ..... 280/624
4,896,895 1/1990 Bettosini ..... 280/607

*Primary Examiner*—Andres Kashnikow
*Assistant Examiner*—Richard Camby
*Attorney, Agent, or Firm*—Young & Thompson

[57] ABSTRACT

The central binding for a ski with a mounting support having separated elements includes, in its lower part, pins (6,7,8,9) which are intended to cooperate with corresponding bayonet openings (12,16,20) provided within the elements constituting the support, as well as screws (40) which are intended to cooperate with screw threads (10) provided in the elements constituting the support. This support is composed of several separated elements which are mounted on the ski (21) with spaces between them. The elements each include a rigid or semi-rigid upper plate (11,14,17) and a resilient lower plate (13,15,18).

2 Claims, 4 Drawing Sheets

CENTRAL BINDING FOR SKI WITH MOUNTING SUPPORT HAVING SEPARATED ELEMENTS

BACKGROUND OF THE INVENTION

1. Field of the Invention

The present invention relates to a central binding for a ski with a mounting support having separated elements and more particularly to a central binding intended to be mounted on a support constituted of several elements which are mounted on a ski.

2. Description of the Related Art

Most central bindings are made in such a manner to be directly mounted on skis with screws.

Embodiments with mounting plates are known. These plates are intended to be mounted on the skis and comprise elements for a quick mounting, for example, openings for bayonets, which are intended to cooperate with corresponding elements mounted under the lower part of the bindings. This concept allows a quick mounting and dismounting of the bindings. The quick dismounting allows one to facilitate the ski maintenance operations which are much easier when the bindings are disassembled. The dismounting of the bindings also allows one to facilitate the transport and the stocking of the skis.

However, the known embodiments of plates for central bindings present several drawbacks, the main one of which is that these plates are made of one piece having a length which is practically equal to the overall length of the binding. These plates are submitted to important efforts, that is they must be made with resistant materials, this implying that these plates are rather rigid. The portion of the ski on which the plate is mounted is therefore made more rigid, there tending to modify the flexion curve of the ski, and thereby presenting the serious drawback of negatively modifying the skiability characteristics.

The plates made of one piece are still presenting same drawback and have a high weight.

SUMMARY OF THE INVENTION

The purpose of the present invention thus consists in obviating drawbacks of the known embodiments. The mounting support is composed of several separated elements which are each of a reduced length. With this concept the mounting support presents the important advantage of not rigidifying the ski and not modifying the flexion curve, this permitting one to use the skiability characteristics of the ski in an optimal manner. The conception of a support in several elements also allows one to obtain an important saving in weight. The elements may be mounted on resilient supports which present the advantage of absorbing the shocks and vibrations. This advantage may improve in a rather important manner the skiability characteristics. The resilient supports can be made not only of resilient plates but also of resilient pads or blocks which present the advantage of providing a longitudinal and lateral damping. The resilient supports may be realized in different thicknesses according to the users. For average and good skiers, an important thickness, for example, 4 to 5 mm, allows the skier to obtain an important damping which guarantees a high comfort of use. For the very good skiers and competitors, a reduced thickness, for example, 1 to 2 mm, allows the skier to obtain an efficient damping while keeping a great precision in skiing. The thickness of the resilient supports can be differentiated, for example, by a reduced thickness in the front part of the binding and a more important thickness in the rear part thereof. These differences in thicknesses permit the skier to modify the angle formed by the sole of the boot and the surface of the ski, which, for example, in competition ski may allow adjustments with the purpose of obtaining for every one an optimal skiability.

These aims are reached with the principles of the invention such as they are defined in the claims.

BRIEF DESCRIPTION OF THE DRAWINGS

The annexed drawings show schematically and by way of example the principles of the invention.

DETAILED DESCRIPTION OF THE PREFERRED EMBODIMENTS

Figure 1:
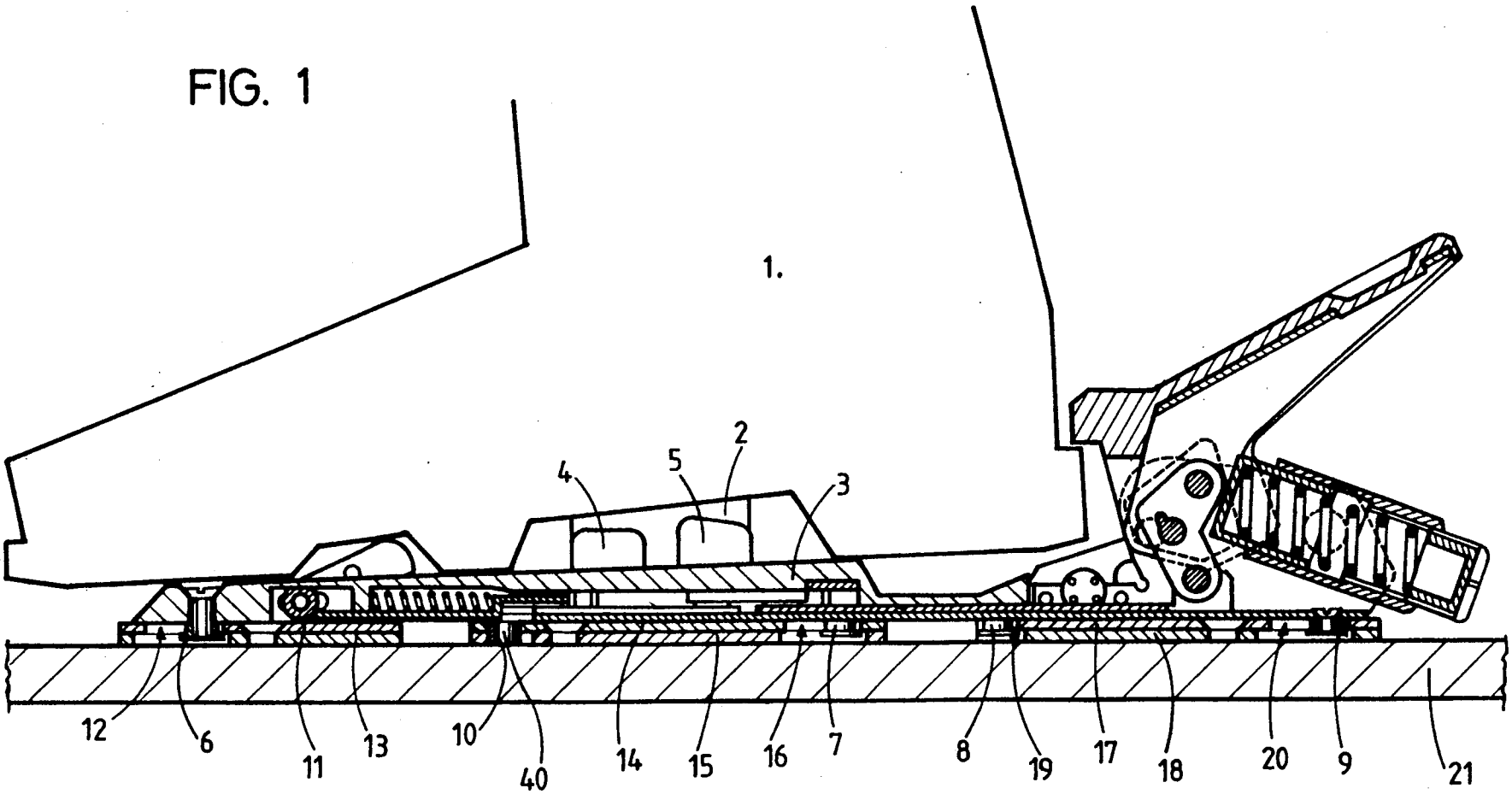
FIG. 1 is a general side section view of a central binding mounted on a mounting support with separated elements.

By reference first to FIG. 1, a central binding 3 comprises lateral gripping elements 4 and 5 which are intended to cooperate with a corresponding formation 2 which is provided within an opening made in the sole of a ski boot 1, in a manner to maintain, in a service position, the boot 1 on the binding. The binding 3 is mounted on a support constituted by several separated elements which comprise rigid or semi-rigid upper plates 11, 14 and 17 which are assembled, for example, by gluing, to resilient lower plates 13, 15 and 18 respectively which are mounted on a ski 21. The upper plates include bayonet openings 12, 16, 19 and 20 which are intended to cooperate with pins 6, 7, 8 and 9 respectively which are mounted under the lower part of the binding 3 and which have screw threads 10 that are intended to cooperate with screws 40 provided in the binding. In practice, the mounting of the binding 3 is carried out by introducing the pins 6, 7, 8 and 9 into the front part of the bayonet openings 12, 16, 19 and 20. The binding 3 is then displaced rearwards in a way that the pins 6, 7, 8 and 9 are introduced in the rear part of the bayonet openings 12, 16, 19 and 20, in which rear part the pins 6, 7, 8 and 9 are vertically maintained. In this position, the screws 40 are introduced in the screw threads 10 in a manner to maintain the binding 3 longitudinally. The dismounting of the binding 3 is carried out by unscrewing the screws 40 and by displacing the binding 3 forwards until the pins 6, 7, 8 and 9 are situated in the part of the bayonet openings 12, 16, 19 and 20 which allows vertical release. The upper plates 11, 14 and 17 are assembled with the resilient plates 13, 15 and 18, for example, by gluing or sticking.

The resilient plates 13, 15 and 18 are themselves mounted on the ski 21 by sticking, for example, with a double face adhesive. The upper plates 11, 14 and 18 can be made of various materials such as aluminum, composite or plastic materials. The resilient plates 13, 15 and 18 can be made in synthetic foam or in rubber molds for example.

Figure 2:
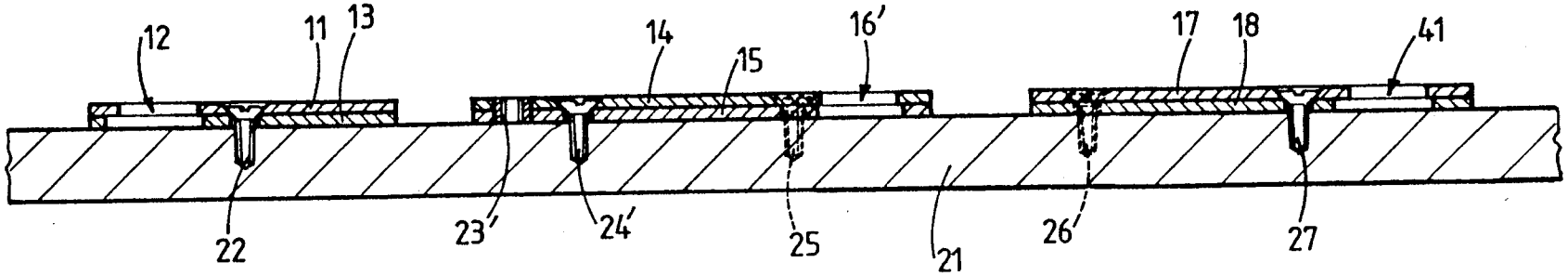
FIGS. 2 and 3 are respectively side section and top plane views of the elements constituting the support mounted on a ski.
Figure 3:
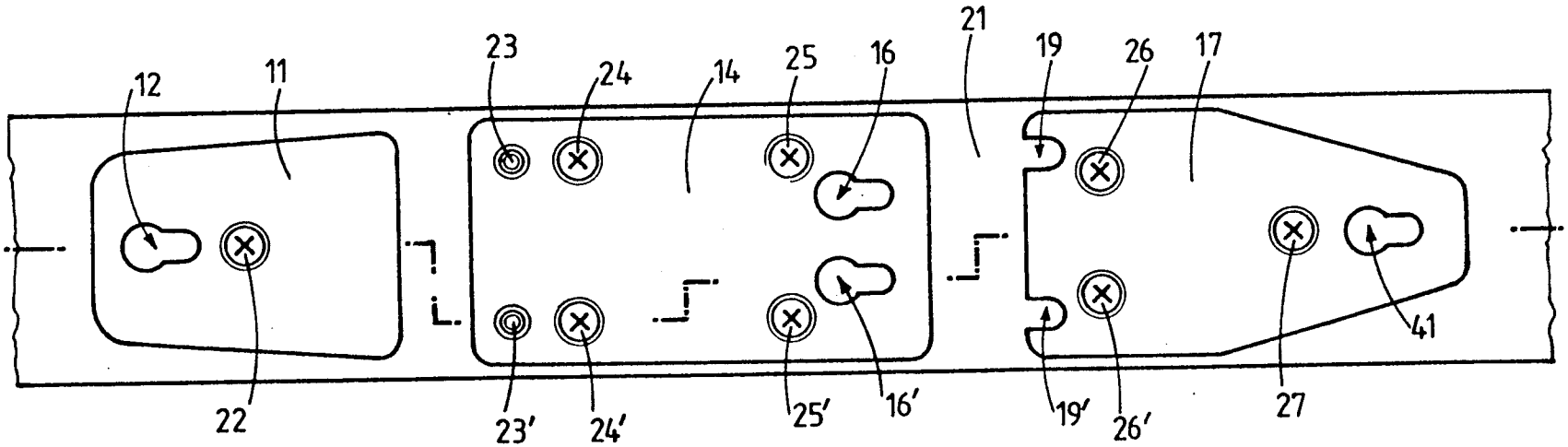

FIGS. 2 and 3 show in detail the mounting support constituted in the embodiment presented by three upper plates 11, 14 and 17 which have bayonet openings 12, 16, 16'26 and 41 which are intended to cooperate with pins mounted under the binding. The upper plates 11, 14 and 17 are mounted respectively on resilient lower plates 13, 15 and 18, which are themselves mounted on the ski 21. The upper plates 11, 14 and 17 are intended to be assembled with the resilient lower plates 13, 15 and 18 by gluing or sticking for example and the resilient lower plates 13, 15 and 18 are intended to be mounted on the ski 21 also by gluing or sticking. In the case of uses in competition for example, the efforts transmitted to the binding and to the different elements constituting the support can be very important, what can necessitate a further security by screws 22, 24, 24', 25, 25', 26, 26' and 27. The central upper plate 14 of the mounting support has bayonet openings 16 and 16' in its rear part and screw threads 23 and 23' in its front part.

Figure 4:
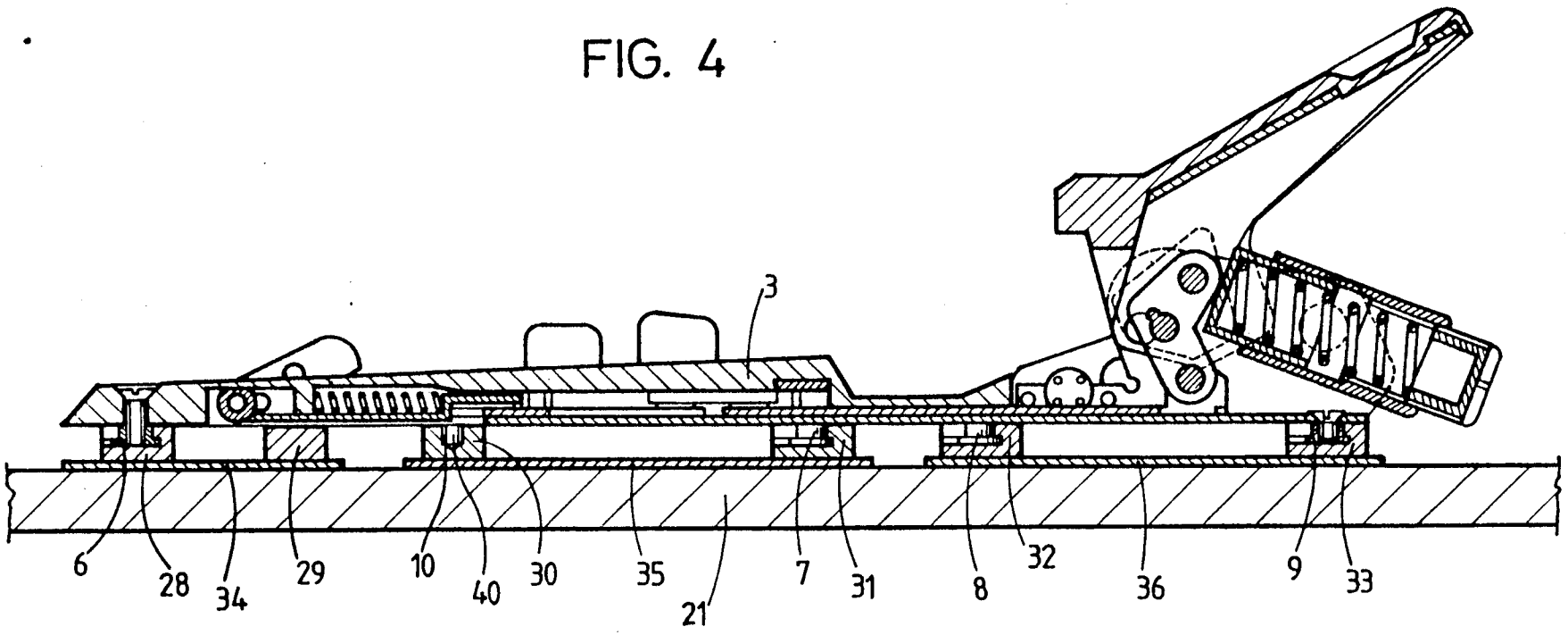
FIG. 4 is a side section view of embodiments of the support with resilient pads or blocks.

FIG. 4 shows an embodiment of the mounting support composed of resilient blocks or pads. The binding 3 comprises pins 6, 7, 8 and 9 which are intended to cooperate with bayonet openings provided in the resilient blocks 28, 31, 32 and 33, and screws 40 which are intended to cooperate with screw threads 10 provided in the blocks 30. The mounting and dismounting of the binding 3 are carried out in the same manner as that for the embodiment described in reference to FIG. 1. The front part of the mounted support comprises blocks 28 and 29 which are rigidly mounted on a plate 34 which is itself mounted on the ski 21. The central part of the support comprises blocks 30 and 31 which are rigidly mounted on the plate 35 which is itself mounted on the ski. The blocks 32 and 33 are fixedly mounted on the plate 36 which is itself mounted on the ski. The plates 34, 35 and 36 are mounted on the ski 21 by gluing or sticking or by screws, for example. The use of the resilient blocks 28–33 presents the advantage of providing a vertical, longitudinal and lateral damping.

Figure 5:
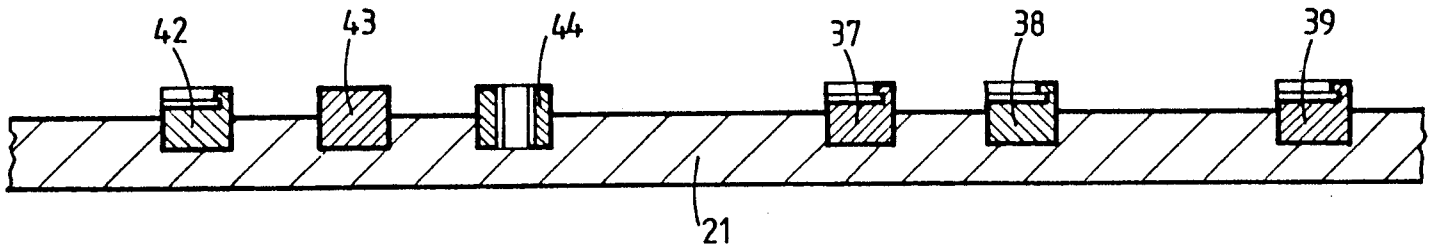
FIGS. 5 and 6 are respectively side section and top plane views of a ski provided with resilient mounting blocks.
Figure 6:
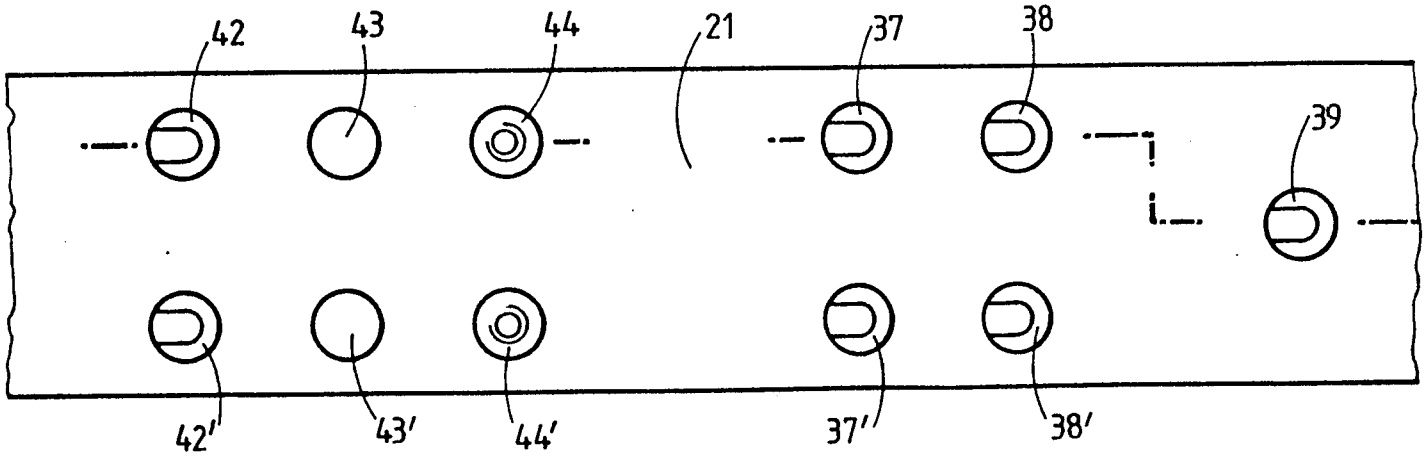

FIGS. 5 and 6 show an embodiment of a support with resilient blocks or pads integrated into the ski. The blocks are constituted by resilient cylindrical elements whose lower part can be introduced and fixed by gluing or sticking, for example, in a corresponding housing provided within the ski, in the case where the blocks are intended to be mounted on existing known skis. This embodiment shows blocks 42, 42', 37, 37', 38, 38' and 39 which include bayonet openings intended to cooperate with the pins of the binding. The blocks 43 and 43' are bearing blocks, and the blocks 44 and 44' include internal screw threads intended to cooperate with the screws of the binding. In the case of skis intended to be used with a central binding, the blocks can be integrated directly into the skis 21 at the time of the moulding of the skis.

The shape of the blocks is independent from the principle of the invention, said blocks can be of a square, rectangular or oval section for example. The blocks can be manufactured in various heights according to the uses foreseen, said height permitting an important resilient damping, the value of the damping decreasing with smaller heights. Differences in the damping can also be obtained by using manufactured materials which are more or less resilient. The height of the blocks can be also progressively different, for example, as a small height for the blocks situated at the front and progressively a higher height for the blocks situated at the rear. This arrangement can permit skier to vary the position of the binding, and thereby of the ski boot 1 with regard to the surface of the ski, that is for example the front portion of the sole of the boot 1 may be situated at a smaller height than the heel thereof, with regard to the surface of the ski.

These variations of height and materials are also applicable for the embodiments with resilient plates.

The embodiments with resilient plates show a mounting support with three separated elements. The number of separated elements is not determining the principle of the invention, because the support can comprise two as well as four separated elements, for example. In the case of embodiments with resilient pads, the number and the disposition of the pads is not determinative as to the principle of the invention. The examples presented comprise eleven blocks by way of example. Other embodiments can necessitate less or more pads which can be disposed differently.

The pins are mounted in the corresponding openings with sufficient clearance in such a manner to allow a displacement which can be provoked by the flexion of the skis.

We claim:

1. A safety binding of a boot on a ski comprising:

a fixing device comprised by two lateral gripping jaws displaceably mounted under the action of elastic means between a closed service position in which these jaws coact with a sole of the boot and an open position;

a mounting support which is secured to an upper surface of the ski, in which the mounting support includes three separate elements being longitudinally spaced one from the other lengthwise of the ski, each said separate element being formed of an upper plate assembled with a resilient lower plate; and wherein each said upper plate has openings that receive pins or screws on said fixing device for removably attaching said fixing device to the mounting support.

2. A safety binding of a boot on a ski, according to claim 1, wherein said openings comprise keyhole openings in each upper plate and screw-threaded openings in one of said upper plates, said keyhole openings receiving headed pins therein and said screw-threaded openings receiving screws therein.

* * * * *